US011453563B2

(12) United States Patent
Wilken

(10) Patent No.: US 11,453,563 B2
(45) Date of Patent: Sep. 27, 2022

(54) GRIPPER ASSEMBLY FOR LIFTING A FLEXIBLE SEMI-FINISHED PRODUCT FROM A SUPPORT, AND A CORRESPONDING METHOD

(71) Applicant: OLBRICH GMBH, Bocholt (DE)

(72) Inventor: Dominic Wilken, Rhede (DE)

(73) Assignee: OLBRICH GmbH, Bocholt (DE)

( * ) Notice: Subject to any disclaimer, the term of this patent is extended or adjusted under 35 U.S.C. 154(b) by 444 days.

(21) Appl. No.: 16/631,397

(22) PCT Filed: Dec. 14, 2018

(86) PCT No.: PCT/EP2018/084940
§ 371 (c)(1),
(2) Date: Jan. 15, 2020

(87) PCT Pub. No.: WO2019/223891
PCT Pub. Date: Nov. 28, 2019

(65) Prior Publication Data

US 2020/0216278 A1 Jul. 9, 2020

(30) Foreign Application Priority Data

May 23, 2018 (DE) ..... 10 2018 112 307.8

(51) Int. Cl.
*B65H 3/08* (2006.01)
*B65H 3/22* (2006.01)
(Continued)

(52) U.S. Cl.
CPC ..... *B65H 3/0816* (2013.01); *B65H 3/22* (2013.01); *B65H 3/56* (2013.01); *B65H 5/14* (2013.01);
(Continued)

(58) Field of Classification Search
CPC ..... B65H 1/04; B65H 3/0816; B65H 3/0825; B65H 3/0833; B65H 3/0883; B65H 3/22;
(Continued)

(56) References Cited

U.S. PATENT DOCUMENTS 3,981,495 A * 9/1976 Bijttebier ..... B65H 3/22 271/18.3
4,127,265 A 11/1978 Wirz et al.
(Continued)

FOREIGN PATENT DOCUMENTS

DE 2621250 B1 3/1977
DE 202007000899 U1 5/2008
(Continued)

OTHER PUBLICATIONS

International Search Report (in English and German) and Written Opinion (in German) issued in PCT/EP2018/084940, dated Apr. 2, 2019; ISA/EP.

*Primary Examiner* — Prasad V Gokhale
(74) *Attorney, Agent, or Firm* — Harness, Dickey & Pierce, P.L.C.

(57) ABSTRACT

A gripper arrangement for lifting a flexible semi-finished product from a support, wherein the gripper arrangement comprises a flexible semi-finished product resting on a support and at least one pair of grippers with a suction gripper or needle gripper and with at least one clamping gripper, wherein the suction or needle gripper is pivotable around an axis between a pick-up position for picking up an edge of the flexible semi-finished product and a transfer position for transferring the edge of the flexible semi-finished product to the clamping gripper. Furthermore, a corresponding method is described.

10 Claims, 6 Drawing Sheets

(51) Int. Cl.
*B65H 3/56* (2006.01)
*B65H 5/14* (2006.01)

(52) U.S. Cl.
CPC .... *B65H 2405/50* (2013.01); *B65H 2405/551* (2013.01); *B65H 2405/60* (2013.01)

(58) Field of Classification Search
CPC .. B65H 3/56; B65H 2405/50; B65H 2405/55; B65H 2405/551
See application file for complete search history.

(56) References Cited

U.S. PATENT DOCUMENTS

| | | | | | |
|---|---|---|---|---|---|
| 5,433,426 | A * | 7/1995 | Bond | ..... | B65H 3/0816 271/106 |
| 5,676,364 | A * | 10/1997 | Shiiki | ..... | B65H 3/0816 271/106 |
| 5,951,001 | A | 9/1999 | Stradi | | |
| 2017/0050342 | A1 | 2/2017 | Hodde | | |

FOREIGN PATENT DOCUMENTS

| | | | |
|---|---|---|---|
| DE | 102012104276 | A1 | 12/2013 |
| DE | 102014226160 | A1 | 6/2016 |
| EP | 0807083 | A1 | 11/1997 |
| GB | 1414899 | A | 11/1975 |
| WO | WO-9923021 | A1 | 5/1999 |
| WO | WO-2015169578 | A1 | 11/2015 |

* cited by examiner

GRIPPER ASSEMBLY FOR LIFTING A FLEXIBLE SEMI-FINISHED PRODUCT FROM A SUPPORT, AND A CORRESPONDING METHOD

CROSS-REFERENCE TO RELATED APPLICATIONS

This application is a 371 U.S. National Phase of International Application No. PCT/EP2018/084940, filed on Dec. 14, 2018, which claims the benefit of German Application No. 10 2018 112 307.8, filed on May 23, 2018. The entire disclosures of the above applications are incorporated herein by reference.

BACKGROUND

This section provides background information related to the present disclosure which is not necessarily prior art.

TECHNICAL FIELD

The invention relates to a gripper arrangement for lifting a flexible semi-finished product from a support and a corresponding method. Gripper arrangements of this kind are used, for example, to pick up, handle and deposit textile semi-finished product layers in the production of fibre-reinforced plastic components, e.g. to transfer a heated and pre-compacted fibre-reinforced semi-finished product from a heating press into a forming press.

DISCUSSION

In the production of fibre-reinforced plastic components it is necessary, after having been pre-compacted and heated in a heating press, to quickly remove the semi-finished fibre product from the heating press and to transfer it to a forming press in which the semi-finished product is given an intended shape and in which the semi-finished product, which is still warm during the forming process, is cooled in order to solidify it. The pre-compacted and heated fibre-reinforced semi-finished product, which is pre-compacted in the heating press, is flexible and can be sticky, which causes it to adhere to the support of the heating press. This makes it difficult to remove the warm and sticky semi-finished product from the heating press, for which it must first be removed from the support of the heating press. Nowadays, this is usually still done manually and is therefore error-prone. The semi-finished product can tear when removed from the heating press, show material inhomogeneities due to excessive tensile stress, or exhibit a crease due to careless handling.

DE 20 2007 000 899 U1 describes a handling arrangement for flexible mat-like material pieces made of fibre materials, for example CFRP. The handling arrangement has one or more handling devices which have a multi-axis manipulator with a handling tool for winding and unwinding at least one piece of material. The handling arrangement also has one or more deposit tables for pieces of material and/or stacks of pieces of material. A reel carrier of the handling arrangement has a receiving device with a suction strip with several switchable suction sections. The suction strip in turn has several individually or groupwise switchable and essentially point-shaped suction elements.

Similar devices and methods are also described in DE 10 2014 226 160 A1 and DE 10 2012 104 276 A1. WO 2015/169578 A1 describes another transport device and a corresponding transport method for transporting a semi-finished product.

SUMMARY

This section provides a general summary of the disclosure, and is not a comprehensive disclosure of its full scope or all of its features It is therefore the task of the invention to further develop a gripper arrangement of the type described above in such a way that it is also suitable for reliably lifting flexible semi-finished products adhering to a support.

Accordingly, it is provided that the gripper arrangement comprises a flexible semi-finished product resting on a support and at least one pair of grippers with a suction gripper or needle gripper and with at least one clamping gripper, wherein the suction or needle gripper is pivotable around an axis between a pick-up position for picking up an edge of the flexible semi-finished product and a transfer position for transferring the edge of the flexible semi-finished product to the clamping gripper.

With the aid of the at least one suction or needle gripper, the flexible semi-finished product, which may be sensitive to tensile stresses, can first be lifted minimally invasively in the edge area with the aid of the suction or needle grippers and detached from the support, making it possible to grip the exposed edge securely with the aid of the clamping gripper. For this purpose it is provided that the suction or needle gripper, after it is in contact with the flexible semi-finished product, pivots around an axis in order to lift the flexible semi-finished product at the edge. The axis may extend parallel to the support. The pivoting movement carried out can be configured in such a way that the suction gripper or needle gripper can be pivoted between a pick-up position, in which the suction gripper or needle gripper is aligned for engagement with the flexible semi-finished product, and a transfer position, in which the edge of the flexible semi-finished product gripped by the suction gripper or needle gripper is aligned with the at least one clamping gripper such that the clamping gripper can grip and hold the edge.

The clamping gripper can be displaceable at least perpendicularly to the support so that a distance between the clamping gripper and the support can be adjustable. This stroke movement of the clamping gripper can be used in particular to carefully detach the flexible semi-finished product which is still adhering to the support over substantial surface sections after the edge of the flexible semi-finished product has been gripped by the clamping gripper, for which purpose the clamping gripper performs a defined stroke movement which takes into account the mechanical properties of the semi-finished product.

The clamping gripper may also be adjustable parallel to the support, the clamping gripper preferably being adjustable in two perpendicular directions extending parallel to a pivot plane of the suction gripper or needle gripper perpendicular to the axis around which the suction gripper or needle gripper is pivotable between the pick-up position and the transfer position.

The suction gripper or needle gripper can be pivoted from the pick-up position to the transfer position by 45° to 90°, for example. In principle, however, the pivoting movement can be limited such that the edge is just sufficiently detached from the support so that the at least one clamping gripper can grip the edge reliably. A further pivoting movement of the suction gripper or needle gripper is not necessary.

The suction gripper or needle gripper and the clamping gripper can align in the transfer position of the suction gripper or needle gripper in a direction parallel to the axis around which the suction gripper or needle gripper is pivotable. This means that by pivoting the suction gripper or needle gripper, which is in engagement with the edge of the flexible semi-finished product, the edge of the flexible semi-finished product is brought into the engagement area of the clamping gripper, so that the clamping gripper itself does not have to perform any translational, rotational or other movement in order to grip the edge area of the flexible semi-finished product.

For gripping the edge, for example, the clamping gripper can have two mutually adjustable clamping jaws between which the flexible semi-finished product can be clamped. For example, the suction gripper or needle gripper can be configured to insert the edge of the flexible semi-finished product between the clamping jaws of the clamping gripper when pivoting from the pick-up position to the transfer position with opened clamping gripper.

The gripper arrangement may comprise at least one gripper bar along which multiple pairs of grippers are arranged, the gripper bar with the pairs of grippers extending along the edge of the flexible semi-finished product. The gripper arrangement may comprise a first and a second gripper bar, the first gripper bar engaging a first of two opposite edges of the flexible semi-finished product and the second gripper bar engaging the second of the opposite edges.

A distance between the gripper bars can be adjustable, particularly the perpendicular distance between the gripper bars. For example, the gripper bars can be arranged parallel to each other. The gripper bars can assume a first distance from each other when the suction grippers or needle grippers are in the pick-up position. The gripper bars can assume a second distance which is greater than the first distance when the flexible semi-finished product is held by the clamping grippers.

The two gripper bars can be fixed to a linear guide via respectively one of two respective opposite faces, wherein the respective other face is a free end of the respective gripper bar. A distance between the gripper bars, for example the perpendicular distance between the two parallel gripper bars, can be adjustable by moving at least one of the gripper bars along the linear guide. The gripper arrangement can be connected to a multi-axis robot via the linear adjustment, so that the multi-axis robot can insert the gripper arrangement via the free ends of the gripper bars between the pairs of plates of the heating press, place it on the flexible component to be accommodated and adjust it relative to one another for releasing the flexible piece from the underside of the heating press.

According to another aspect, a method for lifting a flexible semi-finished product from a support is described, comprising the steps:

providing a flexible semi-finished product arranged on a support and a gripper arrangement which has at least one pair of grippers with at least one suction gripper or needle gripper and at least one clamping gripper;

picking up an edge of the flexible semi-finished product arranged on the support with the at least one suction gripper or needle gripper in a pick-up position of the suction gripper or needle gripper;

pivoting the at least one suction gripper or needle gripper from the pick-up position into a transfer position, wherein the edge is lifted from the support, and transferring the edge of the flexible semi-finished product to the at least one clamping gripper and holding the edge of the flexible semi-finished product with the at least one clamping gripper.

After transferring the flexible semi-finished product to the at least one clamping gripper, the at least one suction gripper or needle gripper can continue to engage with the edge or be out of engagement with the edge. In principle, the clamping grippers should be configured to provide the necessary holding force for manoeuvring the flexible piece.

The method may also comprise the complete lifting of the flexible semi-finished product from the support when the edge of the flexible semi-finished product is held by the at least one clamping gripper.

Lifting the flexible semi-finished product from the support can comprise tensioning of the flexible semi-finished product by lifting the respective edge at opposite edges of the flexible semi-finished product with respectively at least one pair of grippers and increasing the distance between opposite pairs of grippers.

Pivoting the at least one suction or needle gripper from the pick-up position to the transfer position can comprise pivoting the suction gripper or needle gripper by 45° to 90°.

A gripper arrangement of the type described above is preferably used for carrying out the method.

By combining needle grippers or suction grippers and clamping grippers, a small part of the flexible semi-finished product, in particular the edge area of the flexible semi-finished product, can first be lifted from a lower plate of a heating press, for example, before the flexible component is then non-positively gripped with the clamping grippers and lifted from the lower plate of the heating press. This ensures that the heated, flexible semi-finished product, for example a fibre mat, is not damaged when it is lifted. When a pair of gripper bars is arranged at a variable distance from each other via a linear adjustment unit, the size of the gripper arrangement can be smoothly adjusted to the required size of the semi-finished product, thus reducing retooling times and associated costs.

The gripper arrangement can have a pivot drive for the rotation of the suction or needle grippers. For this purpose, several suction or needle grippers can be regularly spaced and synchronously driven along a shaft driven by the pivot drive, which runs e.g. parallel to one of the gripper bars described above. A rotary drive can be provided to control the clamping grippers. Also in this case, the rotary drive can drive a shaft that runs parallel to the gripper bar described above and via which all the clamping grippers arranged along the gripper bar are driven synchronously.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Further details of the invention are explained using the figures below. These show:

DETAILED DESCRIPTION

Figure 1:
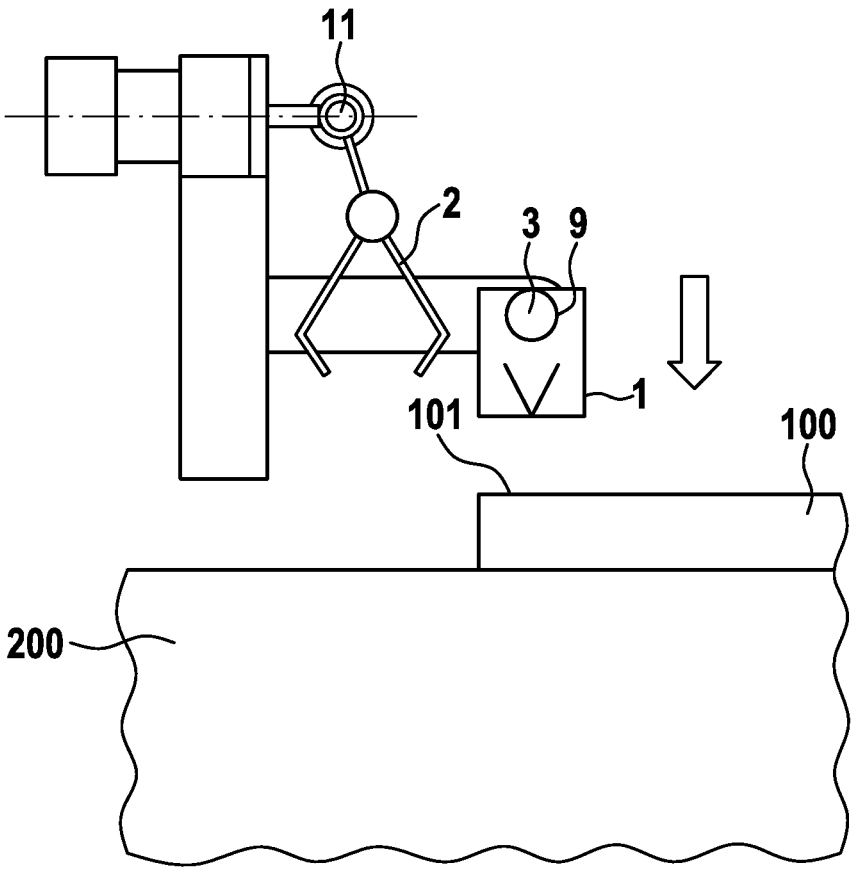
FIGS. 1 to 4 show schematically and step by step the lifting procedure of a flexible semi-finished product by means of a gripper arrangement according to the invention.

Example embodiments will now be described more fully with reference to the accompanying drawings.

FIGS. 1 to 4 show schematically the lifting procedure of a flexible piece 100 using a gripper arrangement according to the invention. The gripper arrangement according to the invention has two functionally different gripper systems, namely at least one suction gripper or needle gripper 1 for lifting an edge area 101 of the flexible semi-finished product 100 and at least one clamping gripper 2 for firmly connecting the flexible piece to the gripper arrangement in order to lift the flexible semi-finished product 100 from the support 200, on which the flexible semi-finished product 100 is placed.

The support 200 can, for example, be the underside of a heating press, within which the flexible semi-finished product, which is provided, for example, as a fibre-reinforced plastic component, is preheated and pre-compacted, so that it can be shaped and cooled in a subsequent processing step in a forming press, so that a fibre-reinforced shaped component is obtained, as it is used, for example, in the car body sector as a parcel shelf, door interior trim, or as an insulating element.

Figure 2:
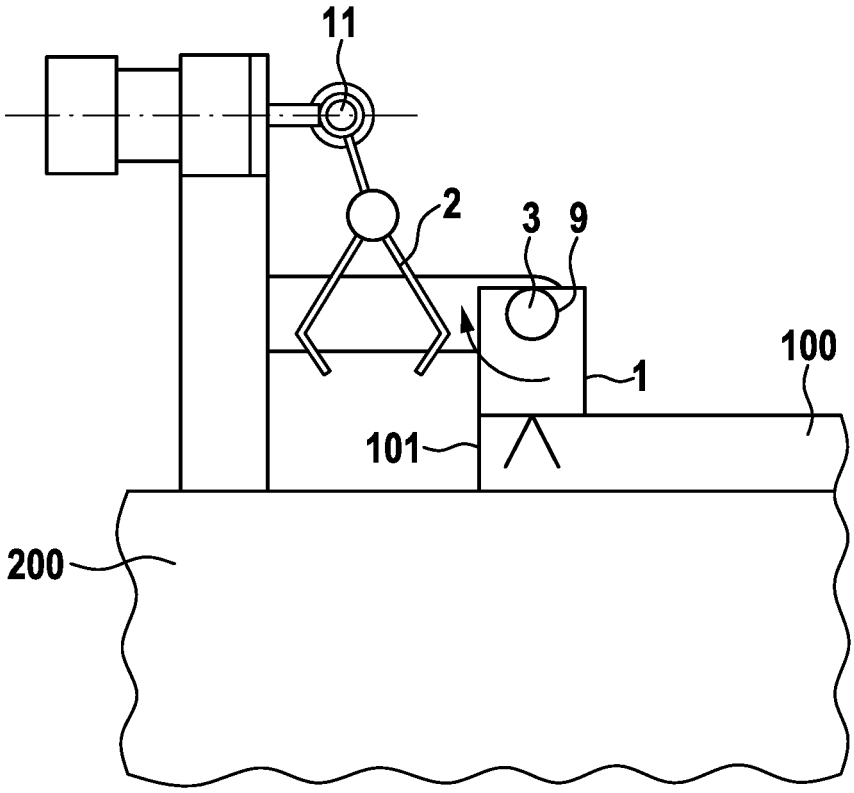

Accordingly, in the first step shown in FIG. 1, the gripper arrangement is first lowered in the direction of the support 200 in such a way that the suction gripper or needle gripper 1 rests on an upper side of the flexible semi-finished product 100 facing away from the support 200. As can be seen in the combination of FIGS. 1 and 2, when the gripper arrangement is placed on the flexible semi-finished product 100 via the suction gripper or needle gripper 1, it can be brought into engagement with the flexible semi-finished product, for example by inserting the gripper needles of the needle gripper 1 into the semi-finished product 100. However, the clamping gripper 2 is still out of engagement with the edge 101 of the flexible semi-finished product 100 in the position of the gripper arrangement shown in FIG. 2.

Figure 3:
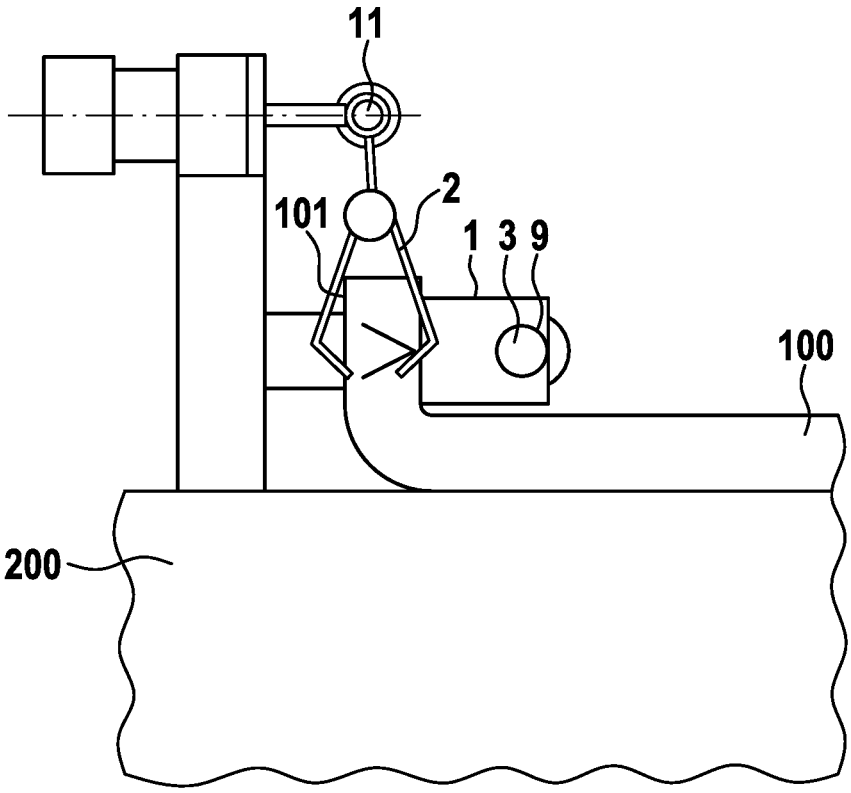

In order to be able to engage the edge 101 of the flexible semi-finished product 100 with the clamping gripper 2, the suction gripper or needle gripper 1, after being engaged with the flexible semi-finished product 100, is pivoted around its pivot axis 3, here by about 90°, while the suction gripper or needle gripper 1 remains engaged with the semi-finished product 100, so that the edge 101 of the flexible semi-finished product 100 is inserted into the open clamping gripper 2, as shown in FIG. 3.

The pick-up position of the suction gripper or needle gripper 1 shown in FIG. 2 and the transfer position of the suction gripper or needle gripper 1 shown in FIG. 3 are offset by 90° to each other. However, it is conceivable that even a pivoting of the suction gripper and needle grippers by 45° is sufficient to insert the edge 101 of the flexible semi-finished product 100 sufficiently deep into the clamping gripper 2 so that the clamping gripper 2 can grip and hold the edge 101 reliably.

As can be seen from the combination of FIGS. 2 and 3, the suction gripper or needle gripper 1 and the clamping gripper 2 are arranged one behind the other in the direction perpendicular to the drawing plane, wherein at least the engagement regions of suction gripper or needle gripper 1 and clamping gripper 2, with which the two types of gripper 1, 2 can be brought into engagement with the edge 101 of the flexible semi-finished product 100, are arranged one behind the other, thus aligned with one another. This enables the edge 101 of the flexible semi-finished product 100 to be automatically brought into the engagement area of the clamping gripper 2 in the course of the pivoting movement of the suction gripper and needle gripper 1, without the clamping gripper 2 having to move towards the edge 101 of the semi-finished product 100 by a further translational or rotational movement in order to grip it.

Figure 4:
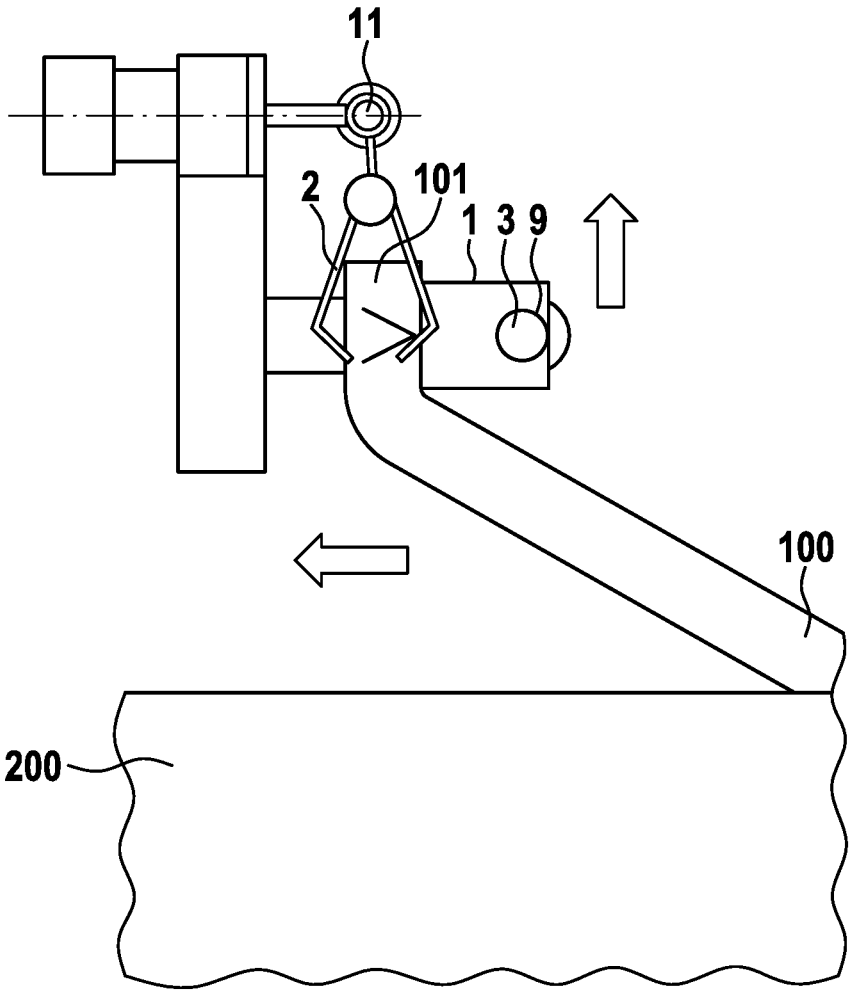

FIG. 4 shows that, after the edge 101 of the flexible semi-finished product 100 is securely held by the clamping gripper 2, the gripper assembly is lifted from the support 200, whereby the edge area of the flexible semi-finished product 100 detached from the support 200 is further extended. This stroke movement can essentially be carried out perpendicular to the support 200. In order to achieve complete detachment of the flexible semi-finished product 100 from the support 200, the gripper arrangement can also perform a movement parallel to the support 200, whereby the semi-finished product 100 is subjected to a tension which detaches it from the support 200. Tensioning the semi-finished product 100 by moving the gripper arrangement parallel to the support 200 not only serves to gently detach the flexible semi-finished product 100 from the support 200, but also has the advantage that the stroke by which the gripper arrangement is moved perpendicular to the support may be limited, for example because there is only limited space between the two pressing tool halves of the heating press in the direction perpendicular to the heating tool halves.

Figure 5:
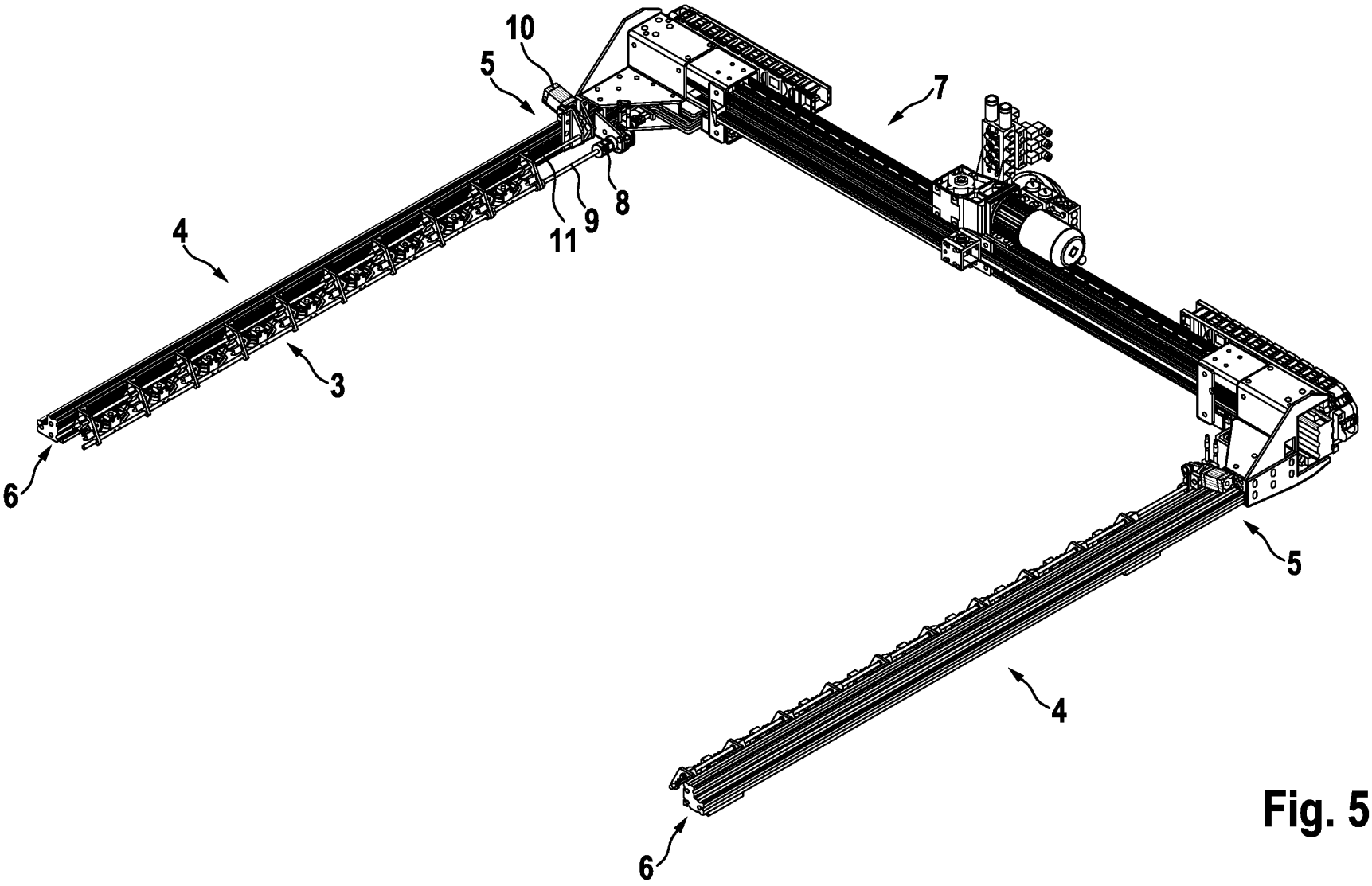
FIG. 5 shows in perspective view, an exemplary embodiments of a gripper arrangement according to the invention.

FIG. 5 shows an exemplary embodiment of a gripper arrangement as it can be used for carrying out the method described with reference to FIGS. 1 to 4. This arrangement essentially consists of a first and a second gripper bar 4, which are attached to a linear guide via one of their two opposite faces 5, 6. The respective opposite face 5, 6 of the gripper bars 4 forms a free end of the gripper bars, via which the gripper bars 4 can be inserted e.g. between the two tool halves of a heating press to be able to be placed on the semi-finished product which is still located in the heating press.

The two gripper bars 4 extend essentially parallel to each other and are adjustable along the linear guide 7, i.e. in the direction perpendicular to the extension direction of the gripper bars 4 towards and away from each other. This adjustment option allows the tensioning movement of the gripper arrangement described in FIG. 4 to detach the flexible semi-finished product 100 from the support 200. Furthermore, a flexible adaptation of the gripper arrangement to the respective dimensions of the semi-finished product to be lifted is possible.

Figure 6:
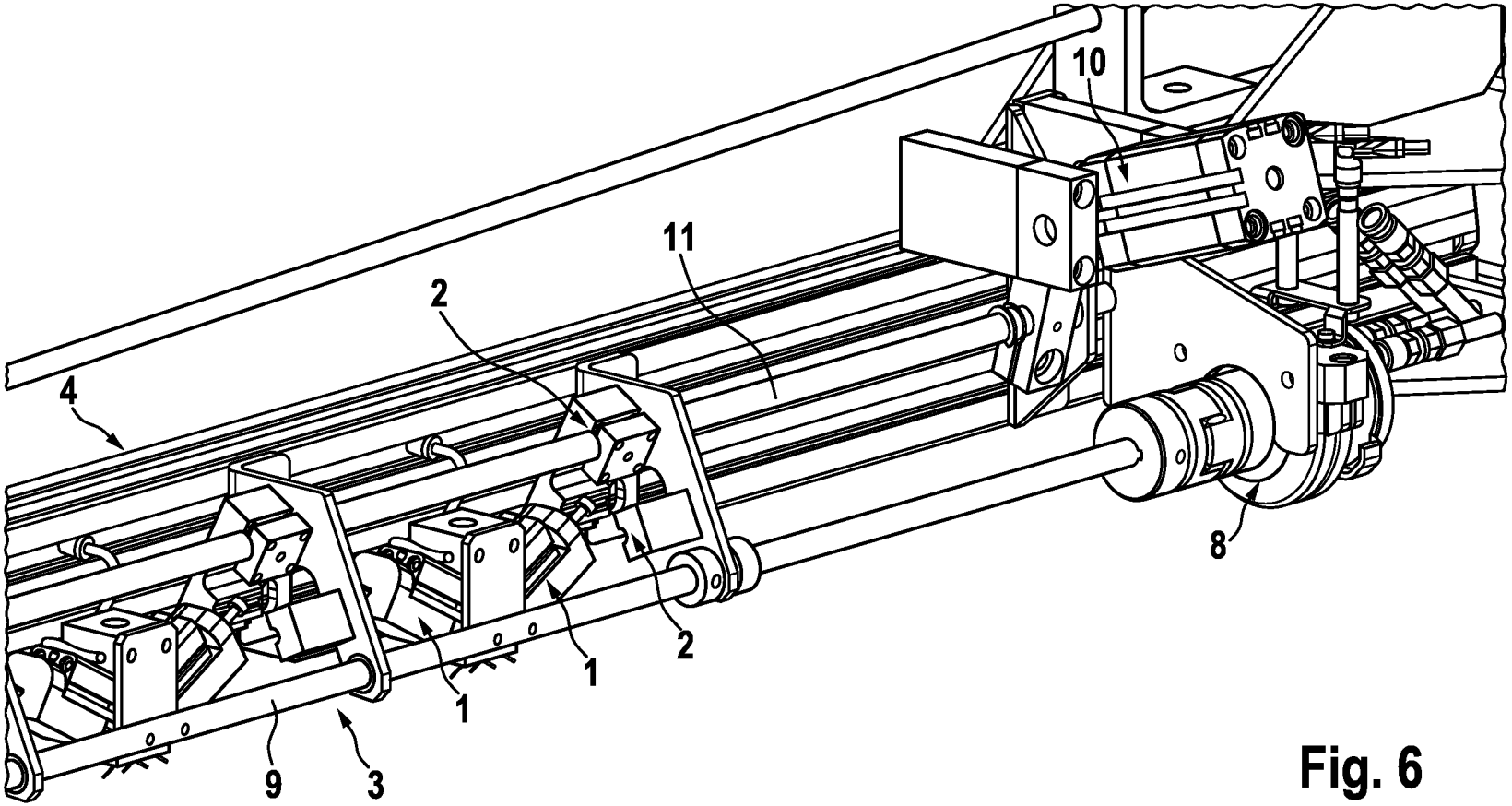
FIG. 6 shows a detailed perspective view of the gripper arrangement according to FIG. 5.

Along each of the gripper bars 4, a plurality of gripper pairs is arranged, each consisting of a suction gripper or needle gripper 1 and a clamping gripper 2, as can be seen more clearly in detail in FIG. 6. Accordingly, the gripper bar 4 has a multitude of gripper pairs 1, 2, which are arranged at a regular distance in the longitudinal extension direction of the gripper bar 4. A pivot drive 8 is provided for the synchronous drive of the suction grippers or needle grippers and a pivot drive 10 for the drive of the clamping grippers. The suction or needle grippers 1 are synchronised via a first drive shaft 9, to which all suction or needle grippers 1 of the gripper bar 4 are connected in a rotationally fixed and positionally true manner. A second pivot drive 10 for the drive of the clamping grippers again has a drive shaft 11 for the synchronous drive of the clamping grippers 2, in particular their clamping jaws, to which all the clamping grippers 2 of the gripper bar 4 are coupled in a rotationally fixed and positionally true manner. The gripper system shown in FIG. 6 can, for example, be maneuvered using a multi-axis robot.

The features of the invention disclosed in the above description, in the drawings and in the claims may be essential to the realisation of the invention, either individually or in any combination.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A gripper arrangement for lifting a limp semi-finished product from a support, wherein the gripper arrangement comprises:

a limp semi-finished product lying on a support and at least one pair of grippers with a suction or needle gripper and with at least one clamping gripper, wherein the suction or needle gripper is pivotable about an axis between a pick-up position for picking up an edge of the limp semi-finished product and a transfer position for transferring the edge of the limp semi-finished product to the clamping gripper, the gripper arrangement having at least one gripper beam along which a plurality of pairs of the grippers are arranged, wherein the gripper beam with the pairs of grippers extends along the edge of the limp semi-finished product, wherein the gripper arrangement comprises a first and a second of the gripper beams, wherein the first gripper beam engages a first of two opposite edges of the limp semi-finished product, and wherein the second gripper beam engages the second of the opposite edges, wherein a distance of the gripper beams from one another is adjustable, wherein the gripper beams assume a first distance from one another when the suction or needle grippers are in the pick-up position, and wherein the gripper beams have a second distance which is greater than the first distance when the limp semi-finished product is held by the clamping grippers.

2. The gripper arrangement according to claim 1, in which the clamping gripper is adjustable at least perpendicularly to a base so that a distance of the clamping gripper from the base is adjustable.

3. The gripper arrangement according to claim 1, in which the clamping gripper is adjustable parallel to the support, wherein the clamping gripper is preferably adjustable in two directions extending perpendicular to each other, which further extend parallel to a pivoting plane of the suction or needle gripper perpendicular to the axis about which the suction or needle gripper is pivotable between the pick-up position and the transfer position.

4. The gripper arrangement according to claim 1, in which the suction or needle gripper is swivelled by 45° to 90° from the pick-up position to the transfer position.

5. The gripper arrangement according to claim 1, in which the suction or needle gripper and the clamping gripper are aligned in the transfer position of the suction or needle gripper in a direction parallel to the axis about which the suction or needle gripper can be pivoted.

6. The gripper arrangement according to claim 1, in which the gripper beams are fixed to a linear guide via one of two opposing end faces each, wherein the respective other end face is a free end of the respective gripper beam, and wherein a distance between the gripper beams can be adjusted by displacing at least one of the gripper beams along the linear guide.

7. A method for lifting a limp semi-finished product from a support, comprising the steps:

Providing a limp semi-finished product arranged on a support and a gripper arrangement comprising at least one pair of grippers with at least one suction or needle gripper and at least one clamping gripper;

Picking up an edge of the limp semi-finished product arranged on the support with the at least one suction or needle gripper in a pick-up position of the suction or needle gripper;

Pivoting the at least one suction or needle gripper from the pick-up position into a transfer position, the edge being lifted off the support;

Transferring the edge of the limp semi-finished product to the at least one clamping gripper and holding the edge of the limp semi-finished product with the at least one clamping gripper, and Complete lifting of the limp semi-finished product from the support when the edge of the limp semi-finished product is held by the at least one clamping gripper, wherein the lifting of the limp semi-finished product from the support comprises the clamping of the limp semi-finished product, for which purpose the respective edge is lifted at opposite edges of the limp semi-finished product by at least one gripper pair in each case and the distance between opposite gripper pairs is increased.

8. The method according to claim 7, in which, after the transfer of the limp semi-finished product to the at least one clamping gripper, the at least one suction or needle gripper continues to engage with the edge or is disengaged from the edge.

9. The method according to claim 7, wherein the pivoting of the at least one suction or needle gripper from the pick-up position to the transfer position comprises the pivoting of the suction or needle gripper by 45° to 90°.

10. The method according to claim 7, in which a gripper arrangement according to claim 1 is used as the gripper arrangement.

* * * * *